US006854403B2

(12) United States Patent
Williams

(10) Patent No.: US 6,854,403 B2
(45) Date of Patent: Feb. 15, 2005

(54) REFRACTORY WALL STRUCTURE AND DAMPER DEVICE

(75) Inventor: Paul Douglas Williams, Hampstead, NC (US)

(73) Assignee: Renewable Energy Corporation Limited, Perth (AU)

( * ) Notice: Subject to any disclaimer, the term of this patent is extended or adjusted under 35 U.S.C. 154(b) by 0 days.

(21) Appl. No.: 10/601,340

(22) Filed: Jun. 20, 2003

(65) Prior Publication Data

US 2004/0094078 A1 May 20, 2004

Related U.S. Application Data

(63) Continuation of application No. PCT/AU01/01655, filed on Dec. 21, 2001.

(30) Foreign Application Priority Data

Dec. 22, 2000 (AU) ..... PR 2292

(51) Int. Cl.[7] ..... F23D 1/02
(52) U.S. Cl. ..... 110/266; 110/310
(58) Field of Search ..... 110/266, 263, 110/347, 342, 310, 309, 297, 210, 214, 331, 336, 213, 264, 233, 234, 163

(56) References Cited

U.S. PATENT DOCUMENTS 1,859,858 A * 5/1932 Wright ..... 122/331
3,955,512 A * 5/1976 Martin et al. ..... 110/222
4,004,056 A 1/1977 Carroll
4,188,915 A 2/1980 Kummel et al.
5,067,419 A * 11/1991 Kobayashi et al. ..... 110/234
5,139,535 A 8/1992 Strickland et al.
5,273,003 A * 12/1993 Rothwell ..... 122/235.28

FOREIGN PATENT DOCUMENTS

JP 9243006 9/1997

OTHER PUBLICATIONS

Derwent Abstract Accession No. 97–510385/47, JP 09243006 A, (ISHI), Sep. 16, 1997.
Derwent Abstract Accession No. 96–152364/16, DE 19527885 A, (EVTE), Mar. 14, 1996.
Derwent Abstract Accession No. 87–094347/14, DD 241265 A, (Inst Energetik/Zre), Dec. 3, 1986.
Derwent Abstract Accession No. 96–038598/04, RU 2036222 C1, (Samusenko VA), May 27, 1995.
International Search Report—PCT/AU01/01655; ISA/Australian Office, Feb. 14, 2002.

* cited by examiner

*Primary Examiner*—Kenneth Rinehart
(74) *Attorney, Agent, or Firm*—Harness, Dickey & Pierce, P.L.C.

(57) ABSTRACT

This invention relates generally to high temperature burners such as a solid fuel burner of the type commonly referred to as a gasifier or gasifier combustor. The invention includes a refractory wall structure having an array of tubular members. Refractory material is arranged about the tubular members so that the tubular members protrude from a wall defined by the refractory material by a distance smaller than the diameter of the tubular members.

12 Claims, 5 Drawing Sheets

REFRACTORY WALL STRUCTURE AND DAMPER DEVICE

CROSS-REFERENCE TO RELATED APPLICATIONS

This application is continuation of International Application No. PCT/AU01/01655 filed 21 Dec. 2001. This application claims the benefit of Australian Application No. PR 2292, filed 22 Dec. 2000. The disclosure(s) of the above applications are incorporated herein by reference.

This invention relates generally to high temperature burners and has particular, though not exclusive, application to a solid fuel burner of the type commonly referred to as a gasifier or gasifier combustor.

BACKGROUND ART

A gasifier generally includes a primary combustion chamber into which solid fuel is loaded on to a grate structure on which it is first dried and gasified via controlled primary combustion. The resultant gas is then transferred into a secondary combustion chamber, which may conveniently be a cycloburner, for further combustion to produce a high temperature relatively clean flue gas able to be used for a variety of purposes, eg. power generation or heating. There is a small residue of inorganic matter.

A gasifier of the general type to which the present invention relates is disclosed, for example in U.S. Pat. No. 4,716,842, and the technology generally is of particular interest in waste recycling, especially with an emphasis on so called "green power" generation. Specific solid fuels which may conveniently be gasified in this way include biological waste, agricultural byproducts, wood waste and biomass.

As with any burner or furnace construction operating at high temperatures, the housing is typically provided with an appropriate renewable lining of refractory material, typically ceramic castings capable of withstanding very high combustion temperatures over extended periods. It has been appreciated in accordance with a first aspect of the present invention that it is possible to improve refractory wall structures for burners and furnaces, whether of the presently discussed type or more generally, in an advantageous manner, by providing what may be viewed as an inverted skeletal configuration.

In a separate aspect, the invention is concerned with enhancing control of the passage by which combustion gases are directed from the primary combustion chamber to the secondary chamber.

SUMMARY OF THE INVENTION

The invention accordingly provides, in a first aspect, a refractory wall structure including an array of tubular members and intervening refractory material arranged so that the tubular members protrude from a nominal internal wall surface defined by the refractory material by a distance smaller than the diameter of the tubular members.

Advantageously, the array of tubular members comprises an array of pipes connected for conveying, in use of a burner or furnace containing said wall structure, fluid (liquid or gas) for cooling the refractory wall structure.

In a conventional refractory wall arrangement, the cooling water pipes are wholly embedded within the refractory material, which is itself typically in tile, brick or otherwise segmented form, or a monolithic casting. It is believed that, as this conventional refractory lining wears away, it is more susceptible than the presently proposed material to cracking and the loss of substantial segments. The proposed refractory material is supported on the skeletal array of protruding cooling water pipes.

Preferably, in the first aspect of the invention, there is further provided a solid fuel burner including:

first wall structure including a roof defining a first combustion chamber;

generally curved wall structure defining a second combustion chamber which operates as a cycloburner; and slot port means arranged adjacent said roof through which the flow of hot combustible gases from said first chamber passes enroute to said second chamber where gas combustion takes place;

wherein at least said roof or said curved wall structure, and optionally both are provided by refractory wall structure according to the invention, with said protruding tubular members exposed to the respective combustion chamber(s).

In an advantageous application, the burner is a gasifier and the first combustion chamber is a gasification chamber.

In a second aspect of the invention, there is provided a gasifier including:

first wall structure defining a gasification chamber;

generally curved wall structure defining a combustion chamber which operates as a cycloburner and where gas combustion takes place;

slot port means arranged for admitting a flow of hot combustible gases from said gasification chamber to said combustion chamber; and moveable control damper means mounted for controlling said flow of hot gases through the port means whereby to manage the respective combustion profiles in said chambers.

In a preferred embodiment the invention extends to a solid fuel gasifier incorporating both aspects of the invention.

BRIEF DESCRIPTION OF THE DRAWINGS

The invention will now be further described, by way of example only, with reference to the accompanying drawings, in which.

DESCRIPTION OF PREFERRED EMBODIMENTS

Figure 1:
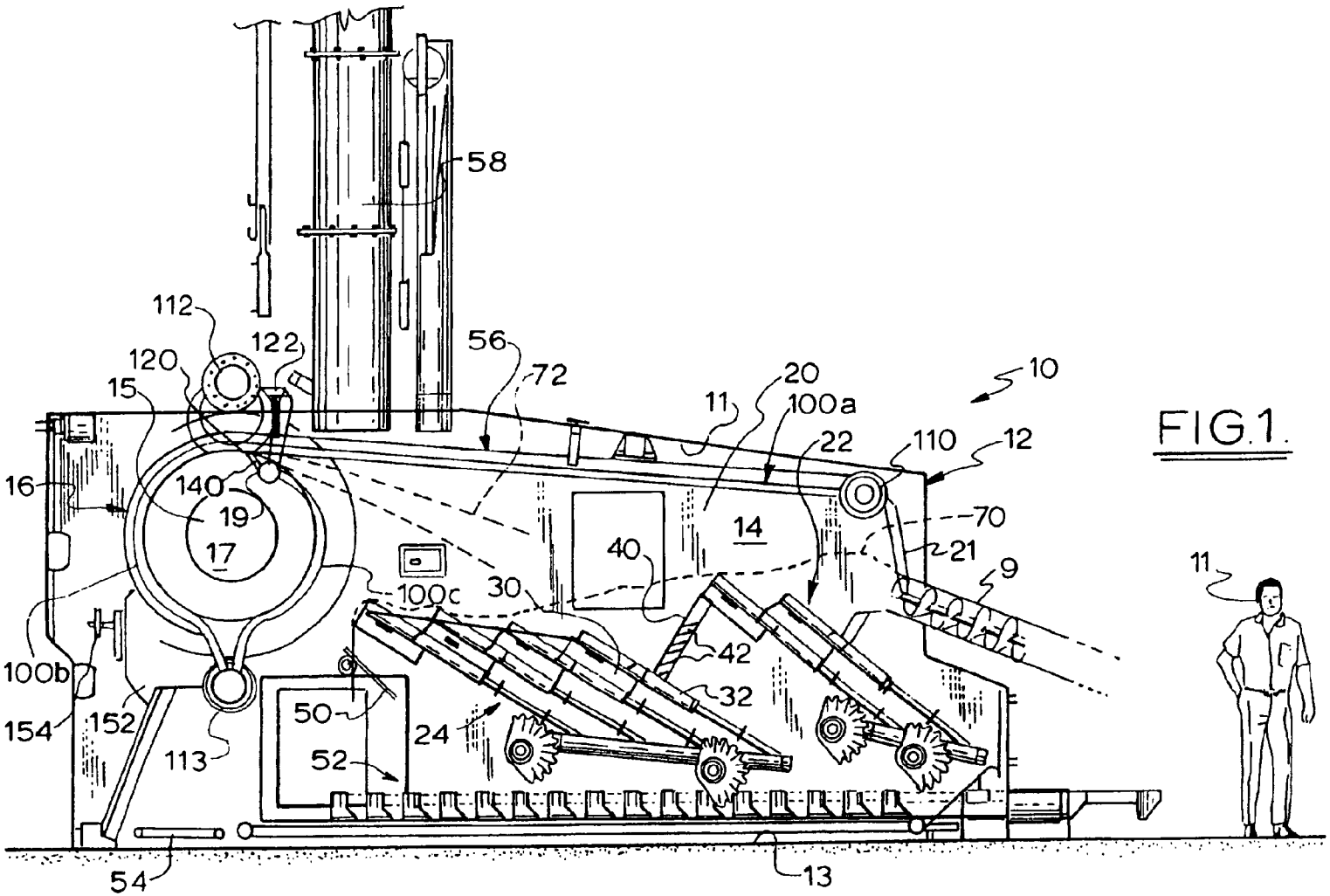
FIG. 1 is a diagrammatic vertical longitudinal section of a solid state gasifier incorporating an embodiment of both aspects of the invention.

The solid fuel gasifier 10 of FIG. 1 (which includes a figure of a man 11 to provide a dimensional context), includes an outer housing 12 about a primary combustion or gasification chamber 14 extending from a fuel delivery auger 9 towards a separately walled cycloburner 16 that defines a secondary combustion chamber 17. A grate structure 20 includes a preheating grate 22 adjacent the delivery end of auger 9, and, downstream in the overall direction of flow of the solid fuel, a gasifier grate 24. The two grates 22, 24 each include stepped pairs of fixed 30 and reciprocating 32 grate segments and are linked by a near vertical grate 40 with multiple angled and controllable openings 42 for admission of combustion air from below the grate structure into the fuel load above. It will be seen that the solid fuel inlet 21 into chamber 14 from auger 9 is generally behind the grate structure 20 relative to the general direction of projection of the grate structure and the overall direction of flow of the solid fuel.

In general, solid fuel delivered via auger 9 accumulates as a deep load or burden 70 on the grate structure while being dried and preheated on grate 22 and gasified above grate 24. Combustible gas (syngas) is drawn through a transverse slot port 19 into chamber 17, from one end 15 of which is recovered combusted flue gas or syngas useable for subsequent heating or power generating purposes. Inorganic solid residue or ash that falls over the downstream end of grate 24 is directed by a baffle device 50 into an ash grate 52 arranged on the heated floor 13 of the housing. The ash is gradually agitated and moved along the floor 13 while remaining carbon is oxidised, for transverse removal and recovery by conveyor 54.

An overhead water-cooled refractory lining 56 is suspended from the roof 11 of housing 10 and merges into the wall structure of cycloburner 16. Lining 56 also defines one edge of slot port 19 through which combustion gases pass from the primary chamber 14 to the secondary chamber 17. Roof 11 supports an emergency exhaust stack 58.

Figure 5:
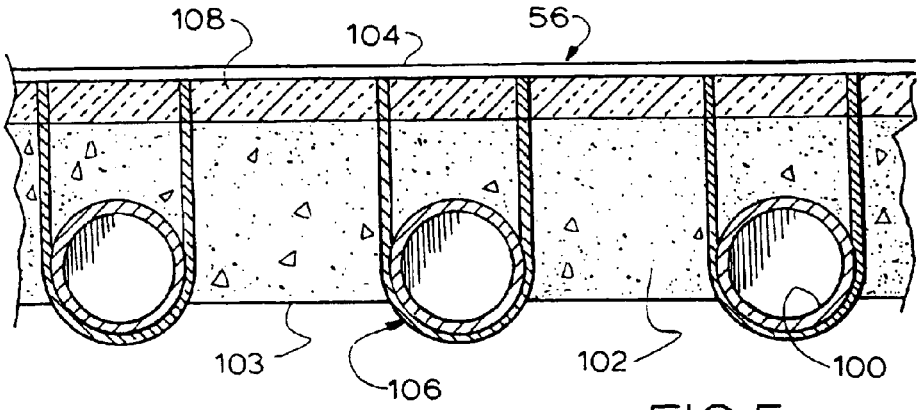
FIG. 5 is a detailed cross-sectional view of the refractory wall structures.

Refractory lining 56 essentially comprises an array of longitudinally extending parallel tubular members or pipes 100, protruding by somewhat less than half their diameter from a nominal wall surface 103 (FIG. 5) defined by a uniform body or layer 102 of refractory material. The overlying supporting substrate is a steel plate 104 to which pipes 100 are attached by spaced U-shaped strips serving as saddles 106. Other types of attachment can be employed. In a preference arrangement, a ceramic fibre blanket 108 lines plate 104. Typically, the blanket is 20 mm thick, the refractory material 100 mm thick and the pipes 100 protrude by about 5 mm.

The pipes 100 are essentially arranged in sets linking respective transverse tubular manifolds 110, 112 and 113. Manifold 110 is at the rear of suspended gasification chamber lining 56 just above the inner end of delivery auger 9, while manifolds 112, 113 are respectively located directly above and below cycloburner 16. A first set of pipes 100*a* extends longitudinally of suspended gasification chamber lining 56 to just inside the top of secondary combustion chamber 17, before looping up to manifold 112. Interlaced between these pipes, pipes 100*b* (as particularly well seen in FIG. 3) loop from the other side of manifold 112 then around the back wall of secondary chamber 17 before diverting away to manifold 113. A denser parallel array of pipes 100*c*, at closer centres than the other arrays, links the front wall 16*a* of cycloburner 16, ie. the wall separating primary and secondary combustion chambers 14, 17, to a transverse tube 120 which is linked to manifold 112 by a set of pipes 122. Tube 120 itself cools the edge of slot port 19 and moreover provides a pivot bearing or guide for linear damper or beak 140 (FIG. 2).

In a modified construction which may better suit some applications, the pipes 100 are omitted from the roof lining 56 and provided only in the walls of secondary chamber 17.

Damper 140 is of generally outwardly tapered cross-section, with a smoothly semi-circular curved free tip edge or rim 142. It is made from two cast elements 144 of high temperature cast alloy fixed together by bolts 145 with a secondary internal transverse cavity 141.

Figure 2:
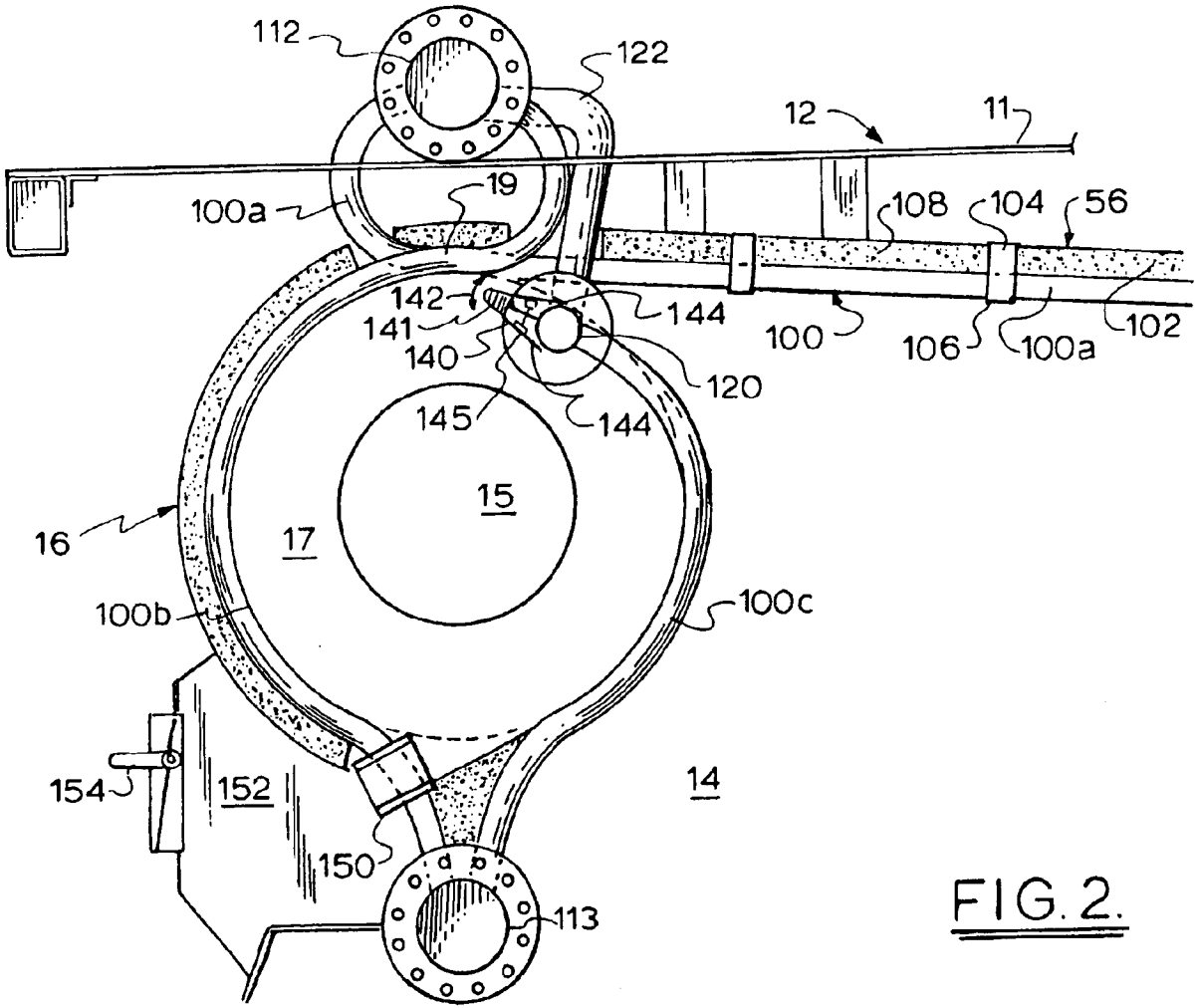
FIG. 2 is a diagrammatic enlargement, with some additional detail, of part of FIG. 1, in the region of the secondary combustion chamber or cycloburner.
Figure 3:
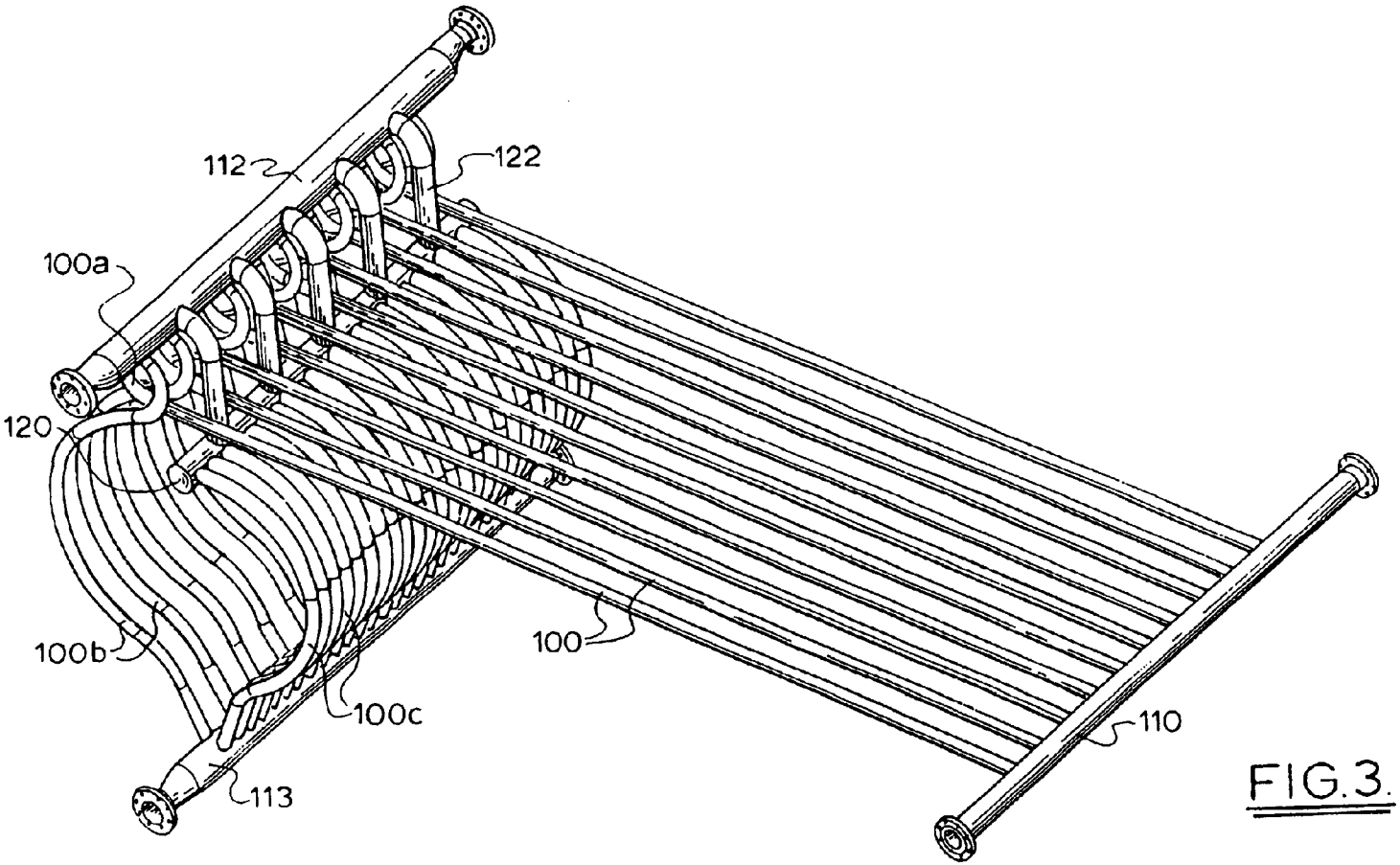
FIG. 3 is a fragmentary isometric view of the suspended water-cooled refractory lining structure of FIG. 1.
Figure 4:
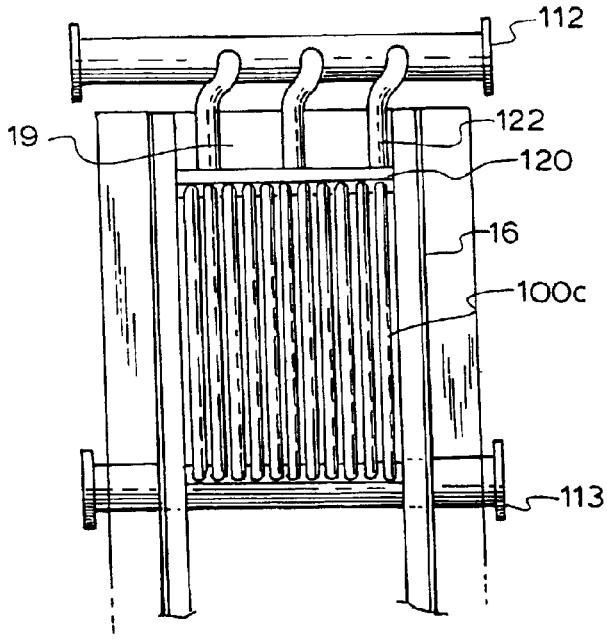
FIG. 4 is an elevational view at A in FIG. 2.

It will be seen from FIG. 2 in particular that by pivoting damper 140 between, say, the positions illustrated in full lines and broken lines, the slot port 19 may be controlled. In particular, damper 40 may be used to close or restrict the passage of syngas from the gasifier chamber 14 and into the cycloburner chamber 17. This beak or damper 40 acts as a damper and constant velocity device. It closes the inlet area as the gasifier chamber 14 is throttled down and therefore maintains a relatively constant velocity of gas through the inlet. This is believed to reduce or particulate and NOx emissions.

Thus, by controlling the inlet gases into the cycloburner 14 using the adjustable beak or damper it is possible to reduce particulates and NOx. The controllable beak in effect acts as an inter-stage damper which provides better control of the output of the cycloburner. It allows greatly increased turn-down capability when heat output is required to decrease, this decrease being achieved by restricting gas flow into the cycloburner and gas flow within the gasifier chamber 17.

Cycloburner 16 is fitted with a further air inlet port 150 at a position substantially diametrically opposite slot port 19. This port is associated with an adjacent transverse chamber 152 in which the air may be heated by the proximate combustion processes, but supply and access of the air is controlled with an air inlet damper 154.

Figure 6:
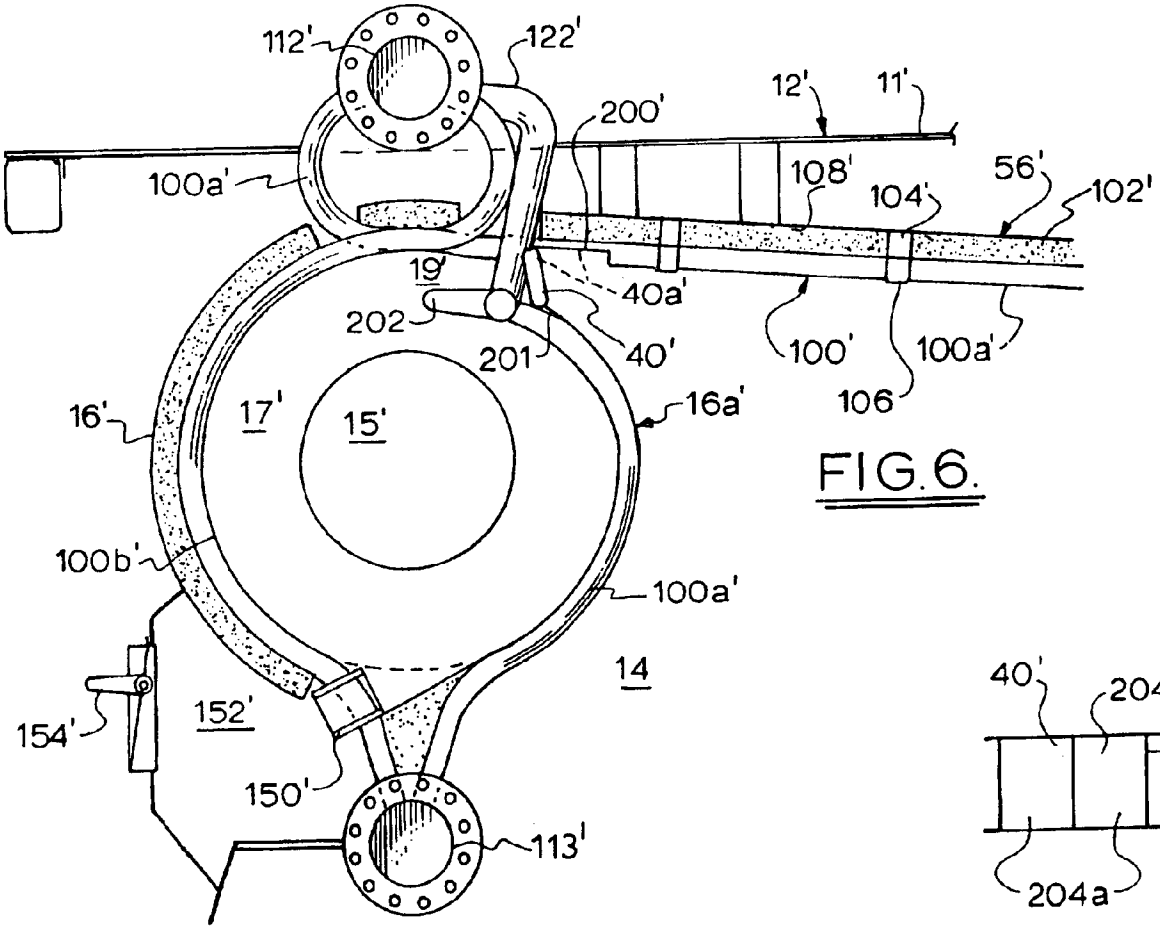
FIG. 6 is a view similar to FIG. 2 of a modified embodiment.

In a modified embodiment illustrated in FIG. 6, in which like parts are indicated by like primed reference numerals, damper 40' is pivotably suspended from roof lining 56' for movement between an open condition (broken lines 40*a*) in a transverse recess 200, in which the damper does not lie in the floor path, and a closed condition in which the outer edge 201 of the damper contacts the front wall 16*a'* of cycloburner 16' and closes slot port 19'. This front wall 16*a'* tapers past the damper to an aerodynamic edge 202 shaped and positioned to minimise turbulence where the entering and revolving flows merge.

It may be preferable for the damper 40 or 40' to be closed at the minimal cross-section of the passage forming slot port 19, 19'.

Figure 7:
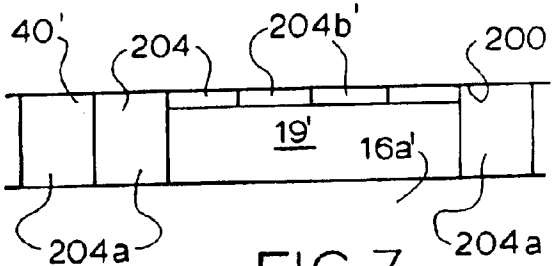
FIG. 7 is a front elevational diagram of a multi-segment damper arrangement.

Damper 40 or 40' may be provided in sections 204 that can be selectively open or closed. FIG. 7 depicts this arrangement, showing some damper sections 204*a* closed and some 204*b* open. This allows an advantageous flexibility in the total area of the passage, and therefore the total volume of flow, from the primary chamber into the secondary chamber.

It is preferred that damper sections 204 are either fully open or fully closed.

In another alternative arrangement (not illustrated), damper 40 is provided as a one or two part plate that slides laterally of the passage, from one or both sides, to vary the width of the port.

What is claimed is:

1. A burner including:

first wall structure including a roof defining a first combustion chamber;

generally curved wall structure defining a second combustion chamber which operates as a cycloburner; and slot port means arranged adjacent said roof through which the flow of hot combustible gases from said first chamber passes enroute to said second chamber where gas combustion takes place;

wherein at least said roof or said curved wall structure are provided by a refractory wall structure including an array of tubular members exposed to the respective combustion chamber(s) and intervening refractory material arranged so that the tubular members protrude from a nominal internal wall surface defined by the refractory material by a distance smaller than the diameter of the tubular members.

2. A burner according to claim 1 wherein the burner is a gasifier and said first combustion chamber is a gasification chamber.

3. A burner according to claim 1 wherein the burner is a solid fuel burner.

4. A burner according to claim 1 wherein the array of tubular members comprises an array of pipes connected for conveying, in use of a burner or furnace containing said wall structure, fluid for cooling the refractory wall structure.

5. A burner according to claim 4 wherein the burner is a gasifier and said first combustion chamber is a gasification chamber.

6. A burner according to claim 4 wherein the burner is a solid fuel burner.

7. A solid fuel gasifier including:

first wall structure defining a gasification chamber;

generally curved wall structure defining a combustion chamber which operates as a cycloburner and where gas combustion takes place;

slot port means arranged for admitting a flow of hot combustible gases from said gasification chamber to said combustion chamber; and moveable control damper means mounted for controlling said flow of hot gases through the port means whereby to manage the respective combustion profiles in said chambers.

8. A solid fuel gasifier according to claim 7 wherein said damper means is pivotally suspended from a roof segment of said first wall structure outside said combustion chamber.

9. A solid fuel burner according to claim 8 wherein said damper means includes a plurality of damper segments each selectively moveable between an open and a closed condition.

10. A solid fuel burner according to claim 7 wherein said damper means includes a plurality of damper segments each selectively moveable between an open and a closed condition.

11. A solid fuel gasifier according to claim 7 wherein at least a roof port of said wall structure, or said curved structure, is at least in part provided by refractory wall structure including an array of tubular members and intervening refractory material arranged so that the tubular members protrude from a nominal internal wall surface defined by the refractory material by a distance smaller than the diameter of the tubular members.

12. A solid fuel gasifier according to claim 11 wherein the array of tubular members comprises an array of pipes connected for conveying, in use of a burner or furnace containing said wall structure, fluid for cooling the refractory wall structure.

* * * * *